United States Patent [19]

Young

[11] Patent Number: 5,044,438

[45] Date of Patent: Sep. 3, 1991

[54] WELLHEAD BOWL PROTECTOR AND RETRIEVING TOOL

[76] Inventor: Joe A. Young, 110 Heath Rd., Scott, La. 70583

[21] Appl. No.: 494,773

[22] Filed: Mar. 16, 1990

[51] Int. Cl.[5] ..... E21B 17/12; E21B 23/00; E21B 31/20

[52] U.S. Cl. ..... 166/250; 166/85; 166/382; 294/86.24

[58] Field of Search ..... 166/379, 380, 382, 181, 166/77.5, 75.1, 83, 85, 98; 294/86.1, 86.24, 86.25, 90, 93; 285/403, 140

[56] References Cited

U.S. PATENT DOCUMENTS

| | | | |
|---|---|---|---|
| 1,447,965 | 3/1923 | Crowell | 166/214 |
| 3,350,130 | 10/1967 | Ahlstone et al. | 294/90 X |
| 3,473,607 | 10/1969 | Castille | 166/85 X |
| 3,489,214 | 1/1970 | Phipps et al. | 166/85 |
| 3,645,328 | 2/1972 | Greene, Jr. | 166/85 |
| 4,361,353 | 11/1982 | Vinson | 294/86.1 |
| 4,591,197 | 5/1986 | Akkerman | 294/86.24 |
| 4,625,381 | 12/1986 | Gravouia, Jr. et al. | 166/85 X |

*Primary Examiner*—Stephen J. Novosad
*Attorney, Agent, or Firm*—Gunn, Lee & Miller

[57] ABSTRACT

A wellhead protection system is disclosed including a wear bushing and retrieving tool. The wear bushing is supported in the wellhead and defines an enlarged upper portion for receiving the retrieving tool. The retrieving tool carries at least one retractable lug member for locking engagement with the wear bushing.

20 Claims, 2 Drawing Sheets

WELLHEAD BOWL PROTECTOR AND RETRIEVING TOOL

BACKGROUND OF THE DISCLOSURE

This invention relates to wellhead tools, particularly to a wellhead bowl protector and retrieving tool for preventing damage to loading and sealing areas in the upper bowl of the wellhead during drilling or workover operations.

A wear bushing or bowl protector is typically positioned in the wellhead immediately below the blowout preventers for the purpose of protecting and preventing damage to the interior of the wellhead during workover or drilling operations. The wear bushing is usually positioned in the wellhead as a new bit or milling tool is run into the wellbore for drilling new or additional hole. In a typical installation, the wear bushing is positioned about the drill string tubing on top of the last stabilizer incorporated in the drill string and lowered into position. The wear bushing is positioned in the wellhead and rests on an internal circumferential shoulder formed in the wellhead. Once the wear bushing is in position, it will take the abusive rotating action of the drill pipe and protect the interior of the wellhead from damage during the drilling operations. Also, the wear bushing protects the interior of the wellhead during addition or pulling, i.e., "tripping", of the pipe in or out of the wellbore.

Periodically during the drilling operation, tripping of the pipe is required for replacement of the drill bit which has been worn-out or dulled to the point that the penetration rate is not acceptable. Also, the drill string may be pulled for conducting various downhole tests which may be required during the drilling operation. During the course of drilling or working over a well, the wear bushing may be positioned in and retrieved from the wellhead several times. Retrieval of the wear bushing from the wellhead generally occurs as the drill string is pulled from the well. Typically the wear bushing rides out of the hole on top of the top most stabilizer in the drill string.

Bowl protectors and retrieving tools are currently available and have been in use for a number of years. The typical retrieving tool is equipped with an affixed or stationary lug or lugs that slide into a J-slot formed in the bowl protector. Once in position, the retrieving tool is rotated slightly so that the protruding lug is retained in the J-slot for carrying the bowl protector out of the wellhead. While this system of removing a bowl protector is workable, it has serious drawbacks. For example, it is difficult to judge the engagement of the lugs on the retrieving tool within the J-slot in the bowl protector, particularly when a substantial length and weight of the drill string is suspended in the wellbore below the retrieving tool. Protruding lugs have often sheared off of retrieving tools employed in this method of removing the well bushing because the lugs were not properly aligned in the J-slot formed in the bowl protector and could not support the weight of the drill string suspended on the retrieving tool. Valuable rig time and expense is thus incurred while another retrieving tool or other means is utilized to remove the bowl protector from the wellbore.

Many wells are drilled on federal leases. Governmental regulations require that frequent wellbore tests be conducted during the drilling process. For example, federal regulations require that blowout preventers be tested at least once a week. In order to test the blowout preventers, the wellhead bowl protector must be removed to permit placement of a test plug in the wellhead immediately below the blowout preventers. To conduct the test, the drilling operator must trip out of the wellbore, thereby removing the bowl protector so that he may conduct the test of the blowout preventers. Tripping out of the well, and consequently tripping back in, may be acceptable for a relatively shallow well, however it is a very expensive use of drill rig time for deeper wells. In such a situation, the drilling operator partially pulls the drill string out of the well and then utilizes a retrieving tool to remove the bowl protector from the wellhead. The apparatus of the present disclosure is particularly suited for reliably and efficiently removing the bowl protector from the wellhead while suspending several thousand feet of drill pipe below the retrieving tool.

It is therefore an object of this invention to provide a wear bushing and retrieving tool which cooperate to remove the wear bushing from the wellhead without the risk of shearing engagement lugs off of the retrieving tool.

It is another object of the invention to provide a wear bushing and retrieving tool including spring actuated lugs received in a circumferential slot formed in the wear bushing for engagement with and removal of the wear bushing from the wellhead.

SUMMARY OF THE INVENTION

This invention is directed to a wear bushing and retrieving tool assembly for preventing damage in the upper bowl of the wellhead during drilling or workover operations. The invention includes a bowl protector or wear bushing adapted for placement in a wellhead for protecting the loading and sealing areas of the wellhead during drill operations. An internal circumferential slot formed in the wear bushing is intersected by at least one vertically extending slot which extends from the upper end of the wear bushing to the circumferential slot. A retrieving tool is utilized to retrieve the wear bushing from the wellhead. The retrieving tool includes spring actuated lug members, which upon alignment with the circumferential slot of the wear bushing, automatically extend into the circumferential slot for locking the retrieving tool to the wear bushing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
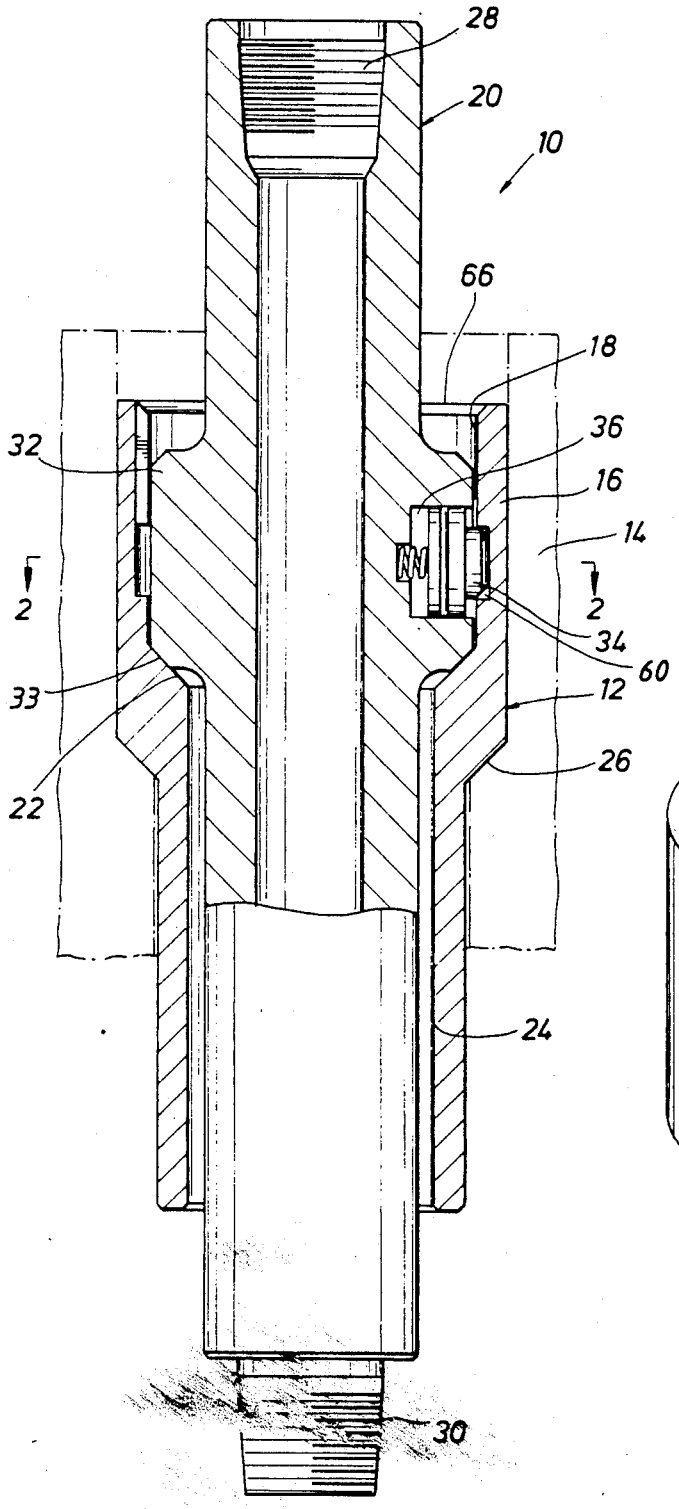
FIG. 1 is a sectional view of the wear bushing and retrieving tool of the invention.

Referring first to FIG. 1, the bowl protector and retrieving tool of the present invention is generally identified by the reference numeral 10. The bowl protector or wear bushing 12 is shown positioned in a wellhead 14. The wellhead 14 is shown in phantom to illustrate the support structure for the wear bushing 12. The wear bushing 12 is located in the wellhead 14 directly below the blow-out preventer stack (not shown in the drawing). The wellhead 14 is connected to the top of the casing which extends into the wellbore formed by the drilling operation.

The wear bushing 12 is a short tubular member having an axial passage extending therethrough and is opened at both ends so that drill pipe and other downhole equipment may pass through the wear bushing 12. The upper end 16 of the wear bushing 12 is enlarged defining an enlarged bore 18 for accommodating the retrieving tool 20 of the present invention. The enlarged bore 18 terminates at an internal circumferential tapering shoulder 22 which defines the transition between the enlarged bore 18 and the thru bore 24 forming the bottom portion of the wear bushing 12. The wear bushing 12 is substantially cylindrical in shape and includes an external circumferential shoulder 26 defining a tapered surface between the enlarged upper end 16 and the lower end of the wear bushing 12. The shoulder 26 is adapted to engage an internal circumferential tapered shoulder formed in the wellhead 14 for supporting the wear bushing 12 within the wellhead 14.

The retrieving tool 20 is a tubular member having an axial passage extending therethrough. The retrieving tool 20 includes an internally threaded box end 28 at the upper end thereof. The lower or pin end 30 of the retrieving tool 20 includes external threads so that the retrieving tool 20 may be incorporated in the drill string. The box end 28 may be connected to the kelly joint or any other tabular member or drill tool incorporated in the drill string and the pin end 30 connects to the top of the string of drill pipe extending down into the wellbore being drilled.

The retrieving tool 20 is substantially tubular in shape and includes an enlarged portion 32 between the box end 28 and pin end 30. The enlarged portion 32 is profiled to be received within the enlarged bore 18 of the wear bushing 12. The external diameter of the enlarged portion 32 is slightly less than the internal diameter of the enlarged bore 18 so that the retrieving tool 20 may easily rotate relative to the wear bushing 12.

Figure 4:
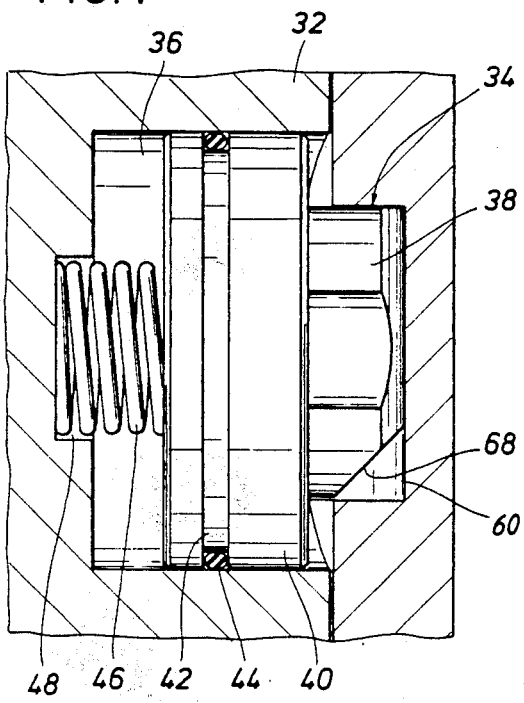
FIG. 4 is a partial sectional of a locking lug member carried on the retrieving tool of the invention.
Figure 5:
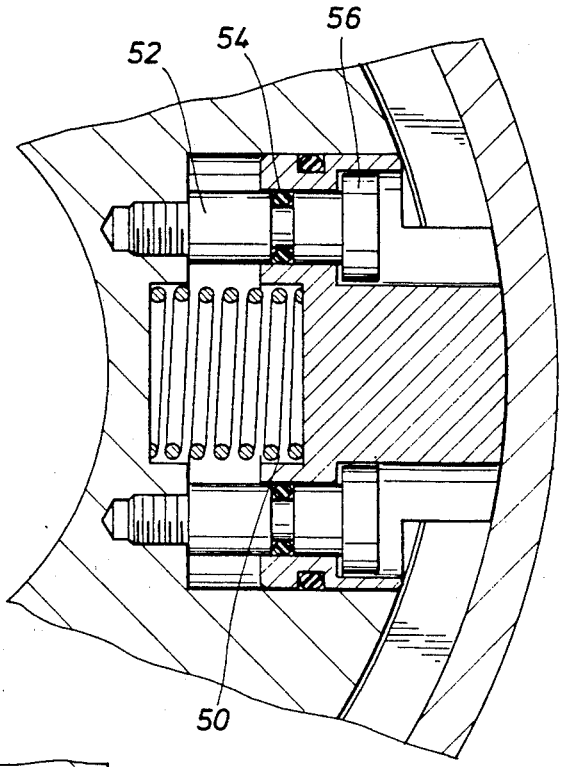
FIG. 5 is a partial sectional view of a locking lug member of the invention.

The retrieving tool 20 carries one or more locking members for engagement with and removal of the wear bushing 12 from the wellhead 14. In the preferred embodiment, the locking members comprise three locking lugs 34 equally spaced about the enlarged portion 32 of the retrieving tool 20. The lugs 34 are received in receptacles 36 formed in the enlarged portion 32 of the retrieving tool 20. Referring now jointly to FIGS. 4 and 5, a lug 34 is shown in greater detail. The lug 34 is received in the receptacle 36. The lug 34 includes a shank portion 38 extending outwardly from a base portion 40. The shank 38 and base 40 form a unitary body of sturdy construction.

A groove 42 is formed about the base 40 of the lug 34. An o- ring 44 is received in the groove 42 for sealing engagement with the internal wall of the receptacle 36. The lug 34 is urged outwardly by a coil spring 46 which engages the backside of the base 40. The coil spring 46 is centrally located within the receptacle 36 having one end received in a recess 48 formed in the base of the receptacle 36. The opposite end of the coil spring 36 is received in a recess 50 formed in the base 40 of the lug 34. Thus, the coil spring 46 is trapped within the recesses 48 and 50 and is not permitted to move laterally within the recess 36. In this manner, the coil spring 46 provides a constant outward force to the lug 34 acting substantially perpendicular to the base 40 of the lug 34 so that the lug 34 moves in and out of the receptacle 36 without binding.

Outward movement of the lug 34 is limited by a pair of lock down bolts 52. The bolts 52 extend through the base 40 and are threaded into the body of the tool 20. The threaded ends of the bolts 52 are received in internally threaded holes formed in the base of the receptacle 36. The shaft of the bolts 52 are only partially threaded as best shown in FIG. 5. The bolts 52 extend through holes formed in the base 40 which have an internal diameter slightly greater than the diameter of the shaft of the bolts 54 so that the lug 34 may be freely extended and retracted in and out the receptacle 36. The unthreaded portion of the shaft of the bolts 52 includes a circumferential groove for receiving an o-ring 54 for sealing engagement with the base 40 of the lug 34. The bolts 52 have enlarged head portions 56 which limit the outward advance of the lug 34. The o-ring seals 44 and 52 seal the receptacle 36 so that mud and debris does enter the receptacle behind the base 40 and thereby prevent retraction of the lug 34.

Figure 2:
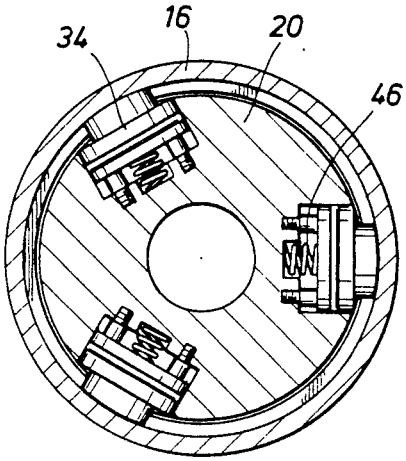
FIG. 2 is a sectional view taken along line 2—2 of FIG. 1.
Figure 3:
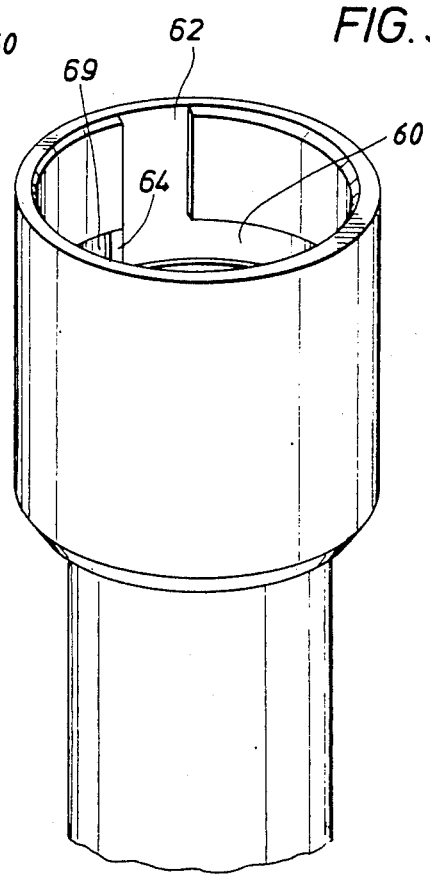
FIG. 3 is a partial perspective view of the wear bushing of the invention.

In the assembled position shown in FIG. 1, the retrieving tool 20 is engaged with the wear bushing 12 for removing the wear bushing 12 from the wellhead 14. In this position, the lugs 34 are forced outwardly by the coil springs 46. The shank portion 38 of the lugs 34 is received in a circumferential slot or recess 60 formed in the enlarged bore 18 of the wear bushing 12. The circumferential slot 60 is intersected by three vertical slots 62 which extend from the upper end of the wear bushing 12 and terminate at the slot 60. The slots 60 and 62 provide a means for engaging and disengaging the retrieving tool 20 from the wear bushing 12. In the engaged position shown in FIGS. 1 and 2, the lugs 34 extend into the slot 60 so that the wear bushing 12 may be lifted out of the wellhead 14. Once removed from the wellhead 14, the wear bushing 12 may be disengaged from the retrieving tool 20 by aligning the vertical slots 62 with the lugs 34 so that the retrieving tool 20 may be pulled upwardly and disengaged from the wear bushing 12. A stop 64 is provided in the slot 60 for aligning the lugs 34 with the vertical slots 62. The stop 64 is an extension of one of the walls of the vertical slots 62 so that upon rotation of the retrieving tool 20 the lugs 34 will be aligned with the slots 62 and the wear bushing 12 may be disengaged from the retrieving tool 20.

In operation, the wear bushing 12 protects the wellhead 14 during drilling operations. When removal of the wear bushing 12 is required, the drill string is raised and several joints of drill tubing are removed from the drill string. The number of joints of tubings removed is selected by the drill operator. The retrieving tool 20 is of sturdy construction for supporting the substantial weight of the drill string extending into the wellbore and therefore may be incorporated in the drill string by threading the pin end 30 of the tool 20 to the uppermost tubing of the drill string extending into the wellbore. The box end 28 of the retrieving tool 20 is threaded to the kelly joint or any other joint forming the drill string above the wellbore. Once connected, the retrieving tool 20 is lowered into the wellhead 14. The lugs 34 at this point project outwardly beyond the enlarged portion 32 of the retrieving tool 20. As the retrieving tool 20 is lowered through the wear bushing 12, the lugs 34 contact the upper internally tapered end 66 of the wear bushing 12. The lower end of the shank 38 of the lugs 34 is provided with a tapered surface 68 for sliding contact with the surface 66 on the wear bushing 12. As the retrieving tool 20 is lowered into the wear bushing 12, the lugs 34 are forced inwardly against the coil springs 46 and slide along the wall of the bore 18. When the external shoulder 33 of the enlarged portion 32 of the retrieving tool 20 engages the tapered shoulder 22 of the wear bushing 12, the lugs 34 are aligned with the slot 60 and are forced outwardly into the slot 60 by the coil springs 46. By monitoring the weight on the drill string, the operator may determine that the retrieving tool 20 is fully engaged with the wear bushing 12 because the weight of the drill string extending in the wellbore, upon engagement of the shoulder 33 of this retrieving tool 20 with tapered shoulder 22 of the wear bushing 12, is supported by the wear bushing 12, and therefore the drill string weight indicator on the drilling platform will register a substantial decrease in drill string weight. The wear bushing 12 may then be removed from the wellhead 14 by raising the drill string out of the wellbore.

Referring again to FIGS. 4 and 5, it will be observed that the forward most end of the shank 38 of the lug 34 includes a radius of curvature so that the lug 34 extends fully into the slot 60 and contacts the inner wall of the wear bushing 12. The radius of curvature of the lugs 34 corresponds to the radius of curvature of the enlarged portion 32 of the retrieving tool 20.

Figure 6:
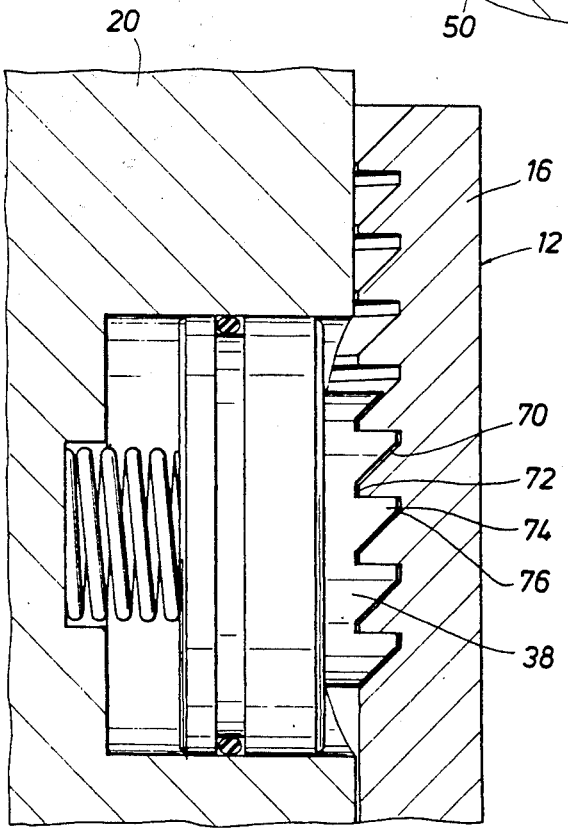
FIG. 6 is a partial sectional view of an alternate embodiment of a locking lug member of the invention.

Referring now to FIG. 6, an alternate embodiment depicting a threaded connection with the wear bushing 12 is shown. The retrieving tool and wear bushing in the embodiment of FIG. 6 are substantially identical to the retrieving tool 20 and wear bushing 12 discussed heretofore. Therefore, like reference numerals are used to identify like elements. In the embodiment of FIG. 6, the enlarged end 16 of the wear bushing 12 is internally threaded with left hand threads so that the wear bushing 12 is not inadvertently unthreaded from the retrieving tool 20. The wear bushing 12 must be rotated to the right to disengage from the retrieving tool 20. The internal threads include an angularly extending surface 70 which extends downwardly toward the rotational center of the wear bushing 12. The surface 70 terminates at a vertically extending flat 72. An inwardly extending horizontal surface 74 extends from the vertical surface 72 to an inner vertical surface 76. The inner vertical surface 76 terminates at the upper end of the angularly extending surface 70 of the adjacent thread. The surfaces 70, 72, 74 and 76 define the profile of a single thread formed on the interior of the enlarged end 16 of the wear bushing 12. The outermost end of shank 38 of each lug 34 is provided with a threaded profile to match the internal threads of the wear bushing 12 as best shown in FIG. 6 for locking engagement therewith.

In use, the retrieving tool 20 of the embodiment of FIG. 6 is lowered into the wear bushing 12 as described above. The springs 46 force the lugs 34 outwardly to threadably engage the wear bushing 12 as shown in FIG. 6. Once removed from the wellhead 14, as previously described, the wear bushing 12 is disengaged from the retrieving tool 20 by simply unscrewing the wear bushing 12.

While the foregoing is directed to the preferred embodiment of the present invention, other and further embodiments of the invention may be devised without departing from the basic scope thereof, and the scope thereof is determined by the claims which follow.

What is claimed is:

1. A wellhead protection system including a wear bushing and a retrieving tool, the improvement comprising:

a) a wear bushing supported within the wellhead, wherein said wear bushing includes an enlarged upper end having an external support shoulder for engagement with an internal support shoulder formed in the wellhead;

b) wherein said wear bushing further includes an internal circumferential slot intersected by at least one vertically extending slot, said vertical slot extending from said circumferential slot to the upper end of said wear bushing;

c) a retrieving tool having at least one outwardly biased, retractable lug member mounted thereon; and d) wherein said retrieving tool includes an enlarged portion adapted to be received within said enlarged upper end of said wear bushing.

2. The wellhead protection system of claim 1 wherein said retrieving tool includes at least one receptacle formed in the enlarged portion thereof for housing said at least one retractable lug member.

3. The wellhead protection system of claim 2 wherein said at least one retractable lug member includes a shank portion projecting from an integral base member, wherein said base member is profiled to be received in said receptacle of said retrieving tool.

4. The wellhead protection system of claim 3 including spring means received within said receptacle for applying an outward force to said at least one retractable lug member for advancing said at least one retractable lug member into engaging contact with said internal circumferential slot for locking said retrieving tool to said wear bushing.

5. The wellhead protection system of clam 4 including at least one bolt extending through the base of said at least one retractable lug member for retaining said lug member within said receptacle, said bolt including stop means for limiting the outward movement of said at least one retractable lug member within said receptacle.

6. The wellhead protection system of claim 5 wherein said shank of said at least one retractable lug member includes an inclined surface for cooperative sliding engagement with the enlarged upper end of said wear bushing for forcing said at least one retractable lug member into said receptacle upon advance of said enlarged portion of said retrieving tool into said enlarged upper end of said wear bushing.

7. The wellhead protection system of claim 6 wherein said retrieving tool supports at least three retractable lug members.

8. The wellhead protection system of claim 1 wherein said enlarged upper end of said wear bushing is internally threaded and said at least one retractable lug member includes a forward portion profiled for locking engagement with the threaded end of said wear bushing.

9. The wellhead protection system of claim 1 wherein said at least one retractable lug member is aligned for advancement into said internal circumferential slot upon contact of said enlarged portion of said retrieving tool with an internal tapered shoulder of said wear bushing.

10. The wellhead protection system of claim 8 wherein said enlarged upper end of said wear bushing is left hand threaded.

11. The wellhead protection system of claim 1 wherein said retrieving tool includes a shoulder on said enlarged portion thereof for engagement with an internal shoulder of the wear bushing for limiting downward travel of said retrieving tool and wherein drill string weight is supported by the wear bushing upon engagement of said retrieving tool with the internal shoulder of the wear bushing.

12. The wellhead protection system of claim 11 wherein engagement of said external shoulder of said retrieving tool with said internal shoulder of said wear bushing postions said retractable lug member for automatic locking engagement with said wear bushing.

13. A method of retrieving a wear bushing from a wellhead comprising the steps of:

a) lowering a retrieving tool into the wellhead for locking engagement with the wear bushing;

b) aligning said retrieving tool with said wear bushing for automatically forcing lug members carried by said retrieving tool outwardly into locking engagement with said wear bushing;

c) monitoring drill string weight for determining engagement of said retrieving tool with said wear bushing, wherein a substantial decrease in drill string weight is an indication that said retrieving tool is engaged with said wear bushing; and d) removing the wear bushing from the wellhead.

14. The method of claim 13 including the step of contacting an internal support shoulder formed in said wear bushing with an external support shoulder formed on said retrieving tool for limiting downward travel of said retrieving tool and aligning said lug members with circumferential recess means formed in said wear bushing.

15. The method of claim 14 including the step of incorporating said retrieving tool above said wear bushing in a drill string extending into the wellhead through said wear bushing.

16. A retrieving tool for removing a wear bushing from a wellhead, comprising:

a) a tubular body having an axial passage extending therethrough, said tubular body including an externally threaded pin end and an internally threaded box end for incorporating said retrieving tool in a drill string:

b) wherein said retrieving tool includes an enlarged portion between said box end and said pin end of said tubular body, said enlarged portion being profiled to be received within an enlarged bore in the wear bushing; and c) outwardly biased, retractable lock means carried on said tubular body for locking engagement with the wear bushing.

17. The retrieving tool of claim 16 including receptacle means formed in said enlarged portion of said tubular body for supporting said lock means therein.

18. The retrieving tool of claim 17 wherein said locking means comprises three retractable lug members, said lug members including a shank portion projecting from an integral base member, wherein said base member is profiled to be received in said receptacle means.

19. The retrieving tool of claim 18 including spring means received within said receptacle means for applying an outward force to said lug members for advancing said lug members into engaging contact with recess means formed in the wear bushing for locking said retrieving tool with the wear bushing.

20. The retrieving tool of claim 19 including connector means extending through the base of said lug members for retaining said lug members within said receptacle means, said connector means including stop means for limiting the outward movement of said lug members within said receptacle means.

* * * * *